United States Patent [19]

Pauls

[11] Patent Number: 4,728,102

[45] Date of Patent: Mar. 1, 1988

[54] RESISTANCE INDICATOR FOR FRICTIONALLY RESISTANT EXERCISE DEVICE

[75] Inventor: Edward A. Pauls, Excelsior, Minn.

[73] Assignee: P.S.I. Nordic Track, Inc., Chaska, Minn.

[21] Appl. No.: 856,192

[22] Filed: Apr. 28, 1986

[51] Int. Cl.[4] ..... A63B 21/00

[52] U.S. Cl. ..... 272/132; 272/DIG. 5; 73/379; 73/862.12

[58] Field of Search ..... 73/379–381, 73/862.12; 272/130–133, 140, DIG. 4, DIG. 5

[56] References Cited

U.S. PATENT DOCUMENTS

| | | | |
|---|---|---|---|
| 1,529,194 | 3/1925 | Liddell . | |
| 3,103,357 | 9/1963 | Byrne | 73/379 X |
| 3,653,659 | 4/1972 | Zinkin | 272/DIG. 5 |
| 3,912,264 | 10/1975 | Busse et al. | 73/379 X |
| 3,929,331 | 12/1975 | Beeding | 73/379 X |
| 3,941,377 | 3/1976 | Lie | 272/57 B |
| 4,023,795 | 5/1977 | Pauls | 272/97 |
| 4,529,194 | 7/1985 | Haaheim | 272/69 |

OTHER PUBLICATIONS

Brochure on Nordic Track Exerciser.

*Primary Examiner*—Richard J. Apley
*Assistant Examiner*—J. Welsh
*Attorney, Agent, or Firm*—Kinney & Lange

[57] ABSTRACT

A resistance or load indicator for use with an exercising unit, in particular one which has motions or movements in opposite directions for exercise, such as reciprocal arm or leg exercisers, and in particular one which can be used with coordinated movements of the arms and legs. The resistance indicator unit comprises an indicator plate that is frictionally loaded to turn from a centered position as the exercise load is applied. The indicator plate is spring loaded so it will turn until the friction control slips. The amount of movement of the spring loaded plate indicates the load being applied in either direction.

4 Claims, 5 Drawing Figures

RESISTANCE INDICATOR FOR FRICTIONALLY RESISTANT EXERCISE DEVICE

BACKGROUND OF THE INVENTION

1. Field of the Invention.

The present invention relates to exercising devices and in particular to indicators that show the amount of resistance to movement being exerted during exercising movements.

2. Description of the Prior Art.

A type of simulated cross country ski exerciser which provides a way of undertaking complete exercise is sold by P.S.I. Nordic Track, of Chaska, Minn., under the mark NORDIC TRACK, and comprises a device for exercising the legs and arms in a coordinated manner. The frictional force resisting the arm and leg movements is adjustable. In particular, the arm exercise portion has easily changed loading members to adjust the load to suit existing conditions, but does not have a resistance force indicator.

SUMMARY OF THE INVENTION

The present invention relates to a resistance force indicator for use with exercising devices to determine the force being exerted during exercise. The resistance force indicator of the present invention is shown during use with an arm exerciser attachment, although it can be used for indicating force exerted during any reciprocal movement exercise device which uses a friction load. The device of the present invention comprises a spring loaded reaction member that is coupled to a movable element of the exerciser so that as the movable element is moved, the reaction member will move, as permitted by the spring mounting, and will yield an amount proportional to the force being exerted.

In the form shown, a rotating drum or reel is utilized for the arm exerciser, and the drum has cord lengths extending in opposite directions therefrom and wound around the drum so that when one cord length is pulled the other cord length will be retracted, and vice versa. The rotating drum or reel is mounted on a reaction plate, that in turn is mounted to yield proportional to the torque being exerted on the plate. The yielding movement is controlled by a resilient resistance mounting for the reaction plate. Friction brake pads are mounted on the reaction plate. One side of the reel or drum engages the brake pads and by exerting the desired amount of load on the reel to move it against the reaction plate and brake pads, the resistance to movement of the drum can be changed, and thus the force needed to overcome the friction to rotate the drum can be changed.

As the drum is moved and slips on the brake pads the friction load will tend to drag the reaction plate with the reel. This movement is resisted by the resilient mounting of the reaction plate. The amount of movement of the reaction plate is proportional to the amount of force needed to rotate the reel or drum. A suitable indicator is provided for simply and easily indicating the amount of movement of the reaction plate and thus the amount of force being exerted in each direction. This permits the person doing the exercise to quickly change the force level to reach a desired level of loading, and to determine where the exercising force level is set.

The indicator is not complex, and provides accurate information on force loading in two directions, so that when such movements in exercising are bi-directional, the force indication is quickly and easily made.

DETAILED DESCRIPTION OF THE PREFERRED EMBODIMENT

Figure 1:
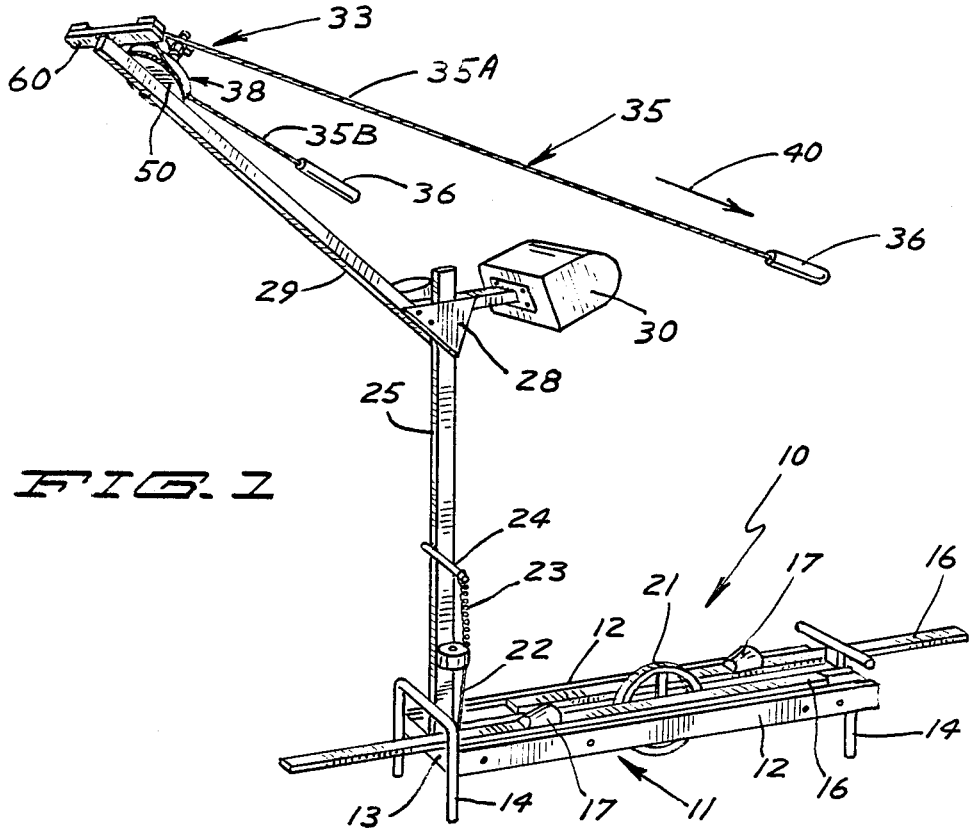
FIG. 1 is a schematic perspective view of a typical exerciser for simulating cross country skiing, and having a force indicating device made according to the present invention installed thereon.

In FIG. 1, a cross country skiing exerciser indicated generally at 10 includes a frame assembly 11 which will support a load element that is driven by the feet. As shown, the element is a friction loaded rotating flywheel element driven by simulated cross country skis or other members which are coupled to the feet of a person doing exercise and are then moved back and forth. The frame includes a pair of side frame members 12,12 which are held together with cross members 13, and are supported on suitable legs 14 with respect to a floor.

Idler rollers (not shown) are supported on the frame for supporting a pair of simulated cross country skis indicated at 16,16 which comprise flat members that have foot attachment bindings 17 thereon. There is one ski on each side of the frame assembly 11, as shown in FIG. 1, and the simulated skis are reciprocated back and forth by the user to simulate a skiing motion. Reference is made to U.S. Pat. No. 4,023,795 for a more detailed showing and description of operation. The bindings 17 are merely strap type devices into which the feet of a person doing the exercise can be placed. The user will move the simulated skis back and forth.

A flywheel 21 is mounted onto a cross shaft for rotation therewith, and as shown in Pat. No. 4,023,795, the flywheel is capable of being loaded under friction by adjusting a friction strap 22 that is mounted over the flywheel and is spring loaded with a spring 23. An adjustable clip 24 is connected to the friction band through the clip and can be adjusted up and down a vertical support post 25 for adjusting the friction load on the flywheel and thus adjusting the load that is exerted by moving the simulated skis. The simulated skis will drive rollers operating through standard one-way clutches as shown in Pat. No. 4,023,795, to in turn drive the flywheel. Additionally, other types of reciprocal movement elements can be utilized for the foot actuation, such as shown in U.S. Pat. No. 4,529,194.

The upright support 25 is attached to the frame assembly 11 in a suitable manner, and can be folded down for storage. The upright support 25 has an adjustable bracket 28 mounted thereon. The bracket can be vertically adjusted along the support and fixed securely in a desired position. An upwardly extending support arm 29 is mounted on bracket 28. A force reaction pad 30 is also mounted on the bracket 28, and extends rearwardly from the support post. This is the reaction member against which a person doing exercise will rest when the simulated skis 16,16 are being operated.

At the outer end of the support arm 29 a rotationally mounted friction loaded drum or reel assembly 33 having an indicator made according to the present invention is mounted. The drum assembly provides an arm exerciser for a user in the form shown, but in situations where the legs are reciprocated, as with skis, and the movement of the legs and feet is such that they also drive in reciprocal directions (back and forth), the same type of force indicator can be used for indicating loads exerted during exercise. For example, in U.S. Pat. No. 1,529,194 the indicator can be used with the drag assembly shown at 96 in such patent. U.S. Pat. No. 3,941,377 also shows an exercising device wherein the foot activated reciprocating members could be coupled to the present force indicator device.

Figure 2:
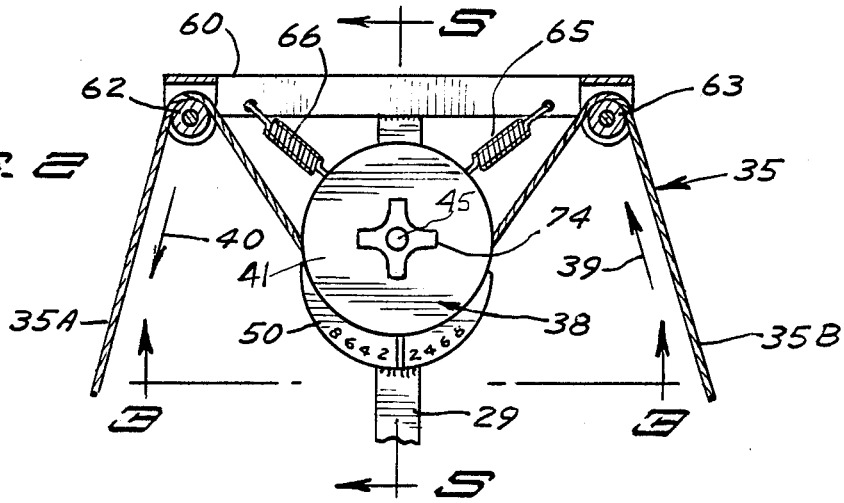
FIG. 2 is a plan view of a typical bi-directional resistance device used for exercising and having a force indicator made according to the present invention thereon.
Figure 3:
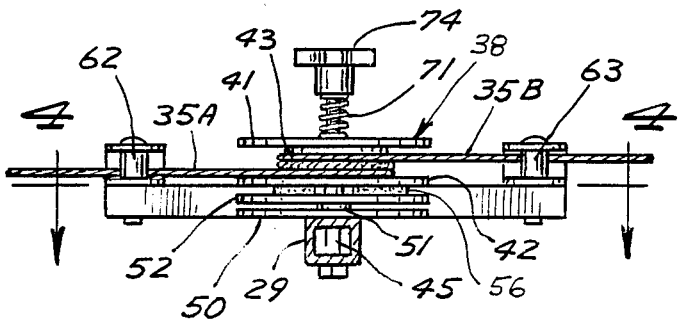
FIG. 3 is a sectional view taken on line 3—3 in FIG. 2.

In the form shown, an arm exercising cord or line 35 having handle members 36 at its opposite ends is wrapped around a rotatable drum or reel 38 a selected number of turns. The line 35 has lengths or portions extending from opposite ends of the drum comprising a first length 35A and a second length 35B which extend outwardly in opposite directions from rotating reel 38. The reel or drum 38 includes a center hub 43 and spaced parallel flat plate flanges 41 and 42 which are fixed to opposite ends of the hub. The separate line lengths 35A and 35B of the cord 35 are wound around the hub of the drum 38 as shown in FIG. 3, for the number of turns that are desired to prevent slipping, for example a half dozen wraps around the drum or reel 38 are satisfactory. When one of the cord lengths, for example length 35A, is pulled in direction as indicated by the arrow 40 (FIGS. 1 and 2), the other length 35B will be pulled toward the drum as indicated by arrow 29 and will wrap around the drum.

Figure 5:
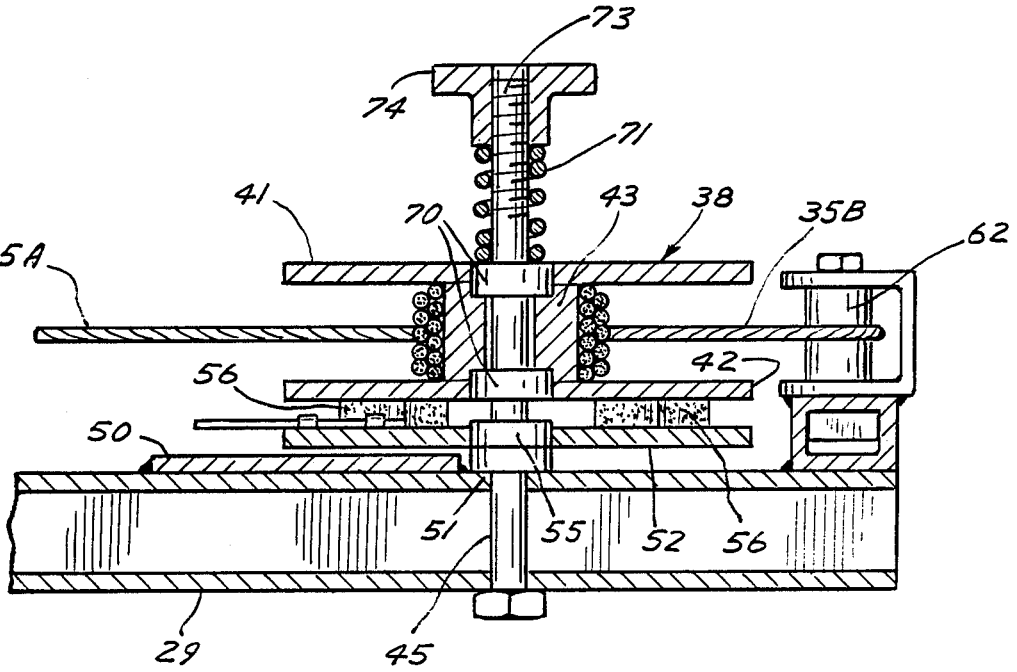
FIG. 5 is a sectional view taken as on line 5—5 in FIG. 2.

The hub 43 of reel 38 is rotatably mounted on a center pin 45 that in turn is fixed to the arm member 29 in a suitable manner. The arm member 29 has a fixed indicator plate or member 50 mounted thereon and extending generally horizontally. As shown in FIG. 5 a thrust bearing 51 is placed between the indicator plate 50 and a rotatably mounted reaction plate 52. The resistance reaction plate 52 is rotatably mounted on the pin 45 with a bearing 55, and rests against the thrust bearing 51. The reaction plate 52, unless restrained, will freely rotate about the pin 45.

Figure 4:
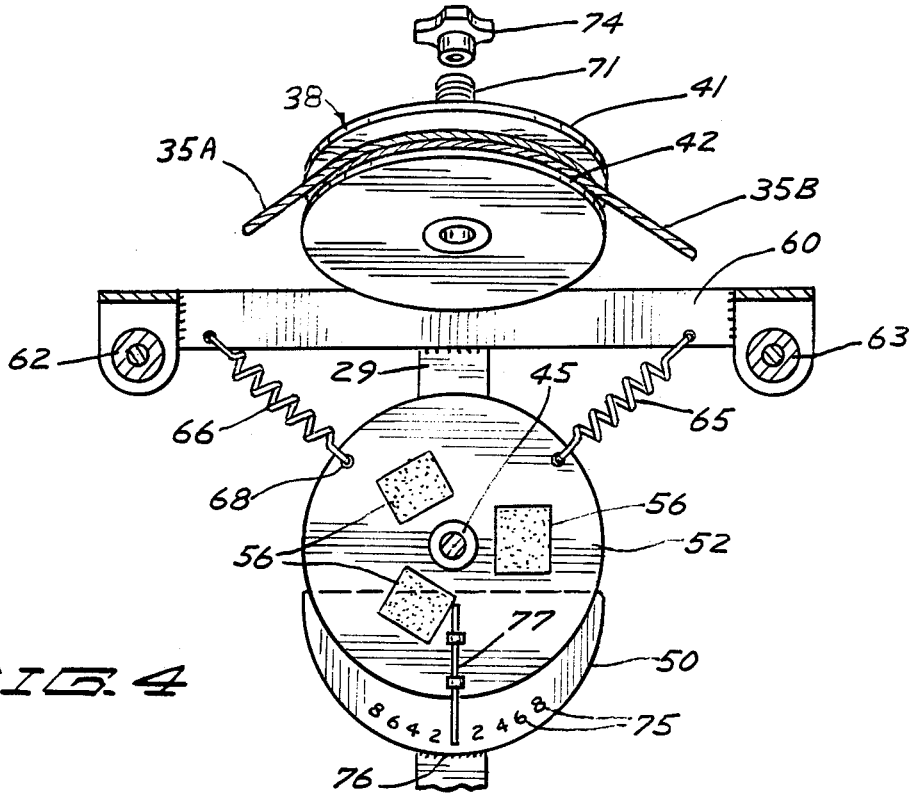
FIG. 4 is an exploded view of the device of the invention showing a brake pad forming a part of the present invention.

The upper surface of the reaction plate 52 has a plurality of brake pads 56 attached thereto, preferably made of oiled leather, which comprise friction material that has a controllable coefficient of friction and which coefficient does not change greatly during use, once an adjustment is made. The pads 56 as shown in FIG. 4 comprise three pads located around the axis of the center in 45.

The arm 29 has a cross bar 60 at its outer end that is fixed to the arm 29 and extends at right angles to the arm. This cross bar 60 serves two purposes. As shown the cross bar mounts pulleys 62 and 63, rspectively, for providing guides for the lengths 35A and 35B of the arm exerciser cord or line. A pair of springs indicated at 65 and 66 have first ends thereof mounted near the respective outer ends of the cross bar 60. The first ends of the springs 65 and 66 are hooked to the cross bars 60, and the opposite ends of the springs are hooked to provided openings in the reaction plate 52 as shown at 67 and 68, respectively in FIG. 4. The springs 65 and 66 comprise resilient members which bias the reaction plate to a centered position.

A pair of bearings indicated at 70 are provided at opposite ends of the hub 43 for the drum 38. The drum or reel 38 can be urged down against the friction pads 56 to vary the force needed to overcome the friction force tending to resist movement and thus to rotate the drum or reel 38. The reaction exerted on reaction plate 52 is the same as the friction force load. The actual force needed on line lengths 35A or 35B to rotate drum 38 depends on the size of the drum, that is, the distance from the axis of pin 45 to the effective radius of action of the brake pads. A spring 71 is mounted over the pin 45 as seen in FIG. 5. The outer end of the pin 45 is threaded as at 73 and a manually adjustable nut 74 is threaded on the end of pin 45 and used for compressing the spring 71 against flange 41 and thus forcing the flange 42 against the friction pads 56 and increasing the friction load on the drum 38 from the brake pads. The indicator plate 50, as shown perhaps best in FIG. 4, is provided with suitable indicia 75 thereon, from a zero centered position shown at 76. An indicator needle 77 is fixed to the reaction plate 52, so that the amount of movement of the reaction plate 52 from its centered position will be indicated by the needle 77 relative to the indicia 75.

The springs 65 and 66 bias the reaction plate to its centered position and can be selected to provide a reasonable range of resistance and travel so for normal loads the reaction plate will move sufficiently to provide a readable and reliable indication. The amount of movement of the reaction disc 52 rotationally about the pin 45 is selected to be adequate to show the range of load normally resulting from exercises. As the nut 74 is tightened down, there is more drag of frictional force exerted by the brake pads and when the drum 38 is moved, it slips against pads 56, but not until the reaction plate 52 has moved rotationally, as resisted by springs 65 or 66, in proportion to the friction load on the drum. The amount of displacement of plate 52 will be indicated by needle 76 relative to indicia 75 so the person exercising knows how much pulling force is being exerted on the rope lengths 35A or 35B.

The resistance indicator assembly, as previously stated, is usable in any location where there is reciprocal movement under load during exercising, and thus is easily adapted to be used to measure loads from the legs in the cross country ski simulators where the legs are moved back and forth on blocks, drive belts or cables.

The construction is simple, straight-forward and foolproof and thus lends itself well to trouble free operation.

The tension springs 65 and 66 can be replaced with other resilient biasing means, such as a center mounted elastomeric member that will load in torsion, or other types of torsion springs, compression springs, leaf springs. The resilient members are needed to provide a biasing force tending to center the reaction disc 52.

Although the present invention has been described with reference to preferred embodiments, workers skilled in the art will recognize that changes may be made in form and detail without departing from the spirit and scope of the invention.

What is claimed is:

1. A resistance force indicating device for an exerciser having a frame where exercising movement actuates a rotating drum under a variable load, comprising a rotating drum having at least one flange surface, said drum being mounted about a drum axis, a platelike reaction member having a surface complemental to the flange surface for reacting the load applied to the rotating drum during the exercising movement, means to mount said reaction member on the frame for rotational movement in two directions about said axis relative to a reference position, spring means acting between the reaction member and the frame to resist rotational movement of said reaction member in each direction, friction pad means to frictionally couple the reaction member directly to the flange surface of the drum so that rotational movement of the drum causes the reaction member to tend to rotate until the load from the drum exceeds a desired level after which the drum can rotate relative to the reaction member, and indicator means operable between the reaction member and the frame for indicating the amount of movement of the reaction member permitted by the spring before the drum rotates relative to the reaction member.

2. The apparatus as specified in claim 1 wherein said rotating drum has a line wrapped thereon, said line having two lengths extending from the drum and coupled to the rotating drum so that upon movement of the line to extend one of the lengths of line from the drum and rotate the drum, the other length of line will be retracted.

3. In a cross country ski exerciser having a frame, first means for exercising the legs of a user by permitting striding movement under load, a force reaction member on the frame for reacting forces from the body of a user of the exerciser, and an arm exerciser for such user comprising a forwardly extending frame member having a drum rotatably mounted on the forwardly extending frame member ahead of the user, said drum having a line thereon, said line having two lengths extending from the drum, and coupled to the rotating drum so that upon movement of the line to extend one of the lengths of line from the drum as the drum rotates the other length of line will be retracted, said drum having at least one flange, the flange facing the forwardly extending frame member, and said drum having means for adjustably loading the drum by applying friction loads thereto, the improvement comprising:

a reaction member comprising a plate that is mounted for movement about the same axis as the drum and positioned between the forwardly extending frame member and the one flange of the drum, friction pad means directly between the plate and the flange of the drum to transfer rotational force to the plate as the drum is rotated, spring means between the plate and the forwardly extending frame member to resist movement of the plate in opposite directions from a centered position so that the plate moves about the axis as a function of the friction force between the one flange of the drum and the plate, indicia means mounted on the forwardly extending frame member, and a radially extending indicator member on the plate, said radially extending indicator member being associated with the indicia means to indicate movement of the plate from its centered position.

4. The improvement as specified in claim 3, wherein said indicia means comprises a indicia member fixed to the forwardly extending frame member, and the indicator member lies directly over the indicia member.

* * * * *